US007788828B2

(12) United States Patent
Krouse

(10) Patent No.: US 7,788,828 B2
(45) Date of Patent: Sep. 7, 2010

(54) ACTIVE SHOE CLEAT SYSTEM

(76) Inventor: Wayne F. Krouse, 5090 Richmond Ave., #390, Houston, TX (US) 77056

( * ) Notice: Subject to any disclaimer, the term of this patent is extended or adjusted under 35 U.S.C. 154(b) by 715 days.

(21) Appl. No.: 11/801,310

(22) Filed: May 9, 2007

(65) Prior Publication Data

US 2007/0261271 A1 Nov. 15, 2007

Related U.S. Application Data

(60) Provisional application No. 60/799,236, filed on May 10, 2006.

(51) Int. Cl.
*A43C 15/02* (2006.01)

(52) U.S. Cl. ..... 36/61; 36/134; 36/59 R

(58) Field of Classification Search ..... 36/61, 36/134, 59 R, 67 R, 132, 136
See application file for complete search history.

(56) References Cited

U.S. PATENT DOCUMENTS 4,873,774 A * 10/1989 Lafever ..... 36/61
5,299,369 A * 4/1994 Goldman ..... 36/61
5,313,718 A 5/1994 McMahon et al.
5,456,027 A 10/1995 Tecchio et al.
5,497,565 A * 3/1996 Balgin ..... 36/61
5,740,619 A 4/1998 Broder
6,125,556 A * 10/2000 Peckler et al. ..... 36/127
6,182,381 B1 2/2001 Kaneko et al.
6,808,462 B2 * 10/2004 Snyder et al. ..... 36/132
7,310,895 B2 * 12/2007 Whittlesey et al. ..... 36/137
2008/0066348 A1 * 3/2008 O'Brien et al. ..... 36/100

* cited by examiner

*Primary Examiner*—Ted Kavanaugh

(57) ABSTRACT

An active shoe cleat system with a shoe having a processor in the shoe operably connected to cleats on the bottom of the shoe, at least one sensor that measures at least one parameter pertaining to ambient conditions on the shoe, a projection within the cleats that are deployed in response to control signals from the processor generated in response to data from information provided in part by the sensor, and means for urging the projection outward from within the cleat. In a preferred embodiment, the cleat may be activated by hydraulics or pneumatics or have a direct motor driven cable, gear or shaft work system. The sensors may monitor a variety of ambient conditions such as speed, torque, acceleration, force, water presence or other factors affecting traction and performance.

15 Claims, 6 Drawing Sheets

ACTIVE SHOE CLEAT SYSTEM

CROSS REFERENCE TO RELATED APPLICATIONS

The present application is related to the following U.S. patent application: provisional patent application No. 60/799,236 titled "Methods and apparatus for an active shoe cleat system" filed on May 10, 2006, which is hereby incorporated by reference as if fully set forth herein.

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of athletic shoes and more specifically to system for active and controlled shoe cleats.

There are a variety of prior art systems for extending cleats from a shoe but none have used the innovative combination of active electronic sensing and active drive control of the present invention. There are a number of patents that disclose a variety of retractable and extendable cleats, including U.S. Pat. No. 5,740,619 entitled "Retractable Stud"; U.S. Pat. No. 5,313,718 entitled "Athletic Shoe With Bendable Traction Projections"; and U.S. Pat. No. 4,873,774 entitled "Shoe Sole With Retractable Cleats." None of these patents shows the innovative combination of the present invention and its use of ambient sensors and active systems for deploying traction enhancing elements on the shoe. Other patents such as U.S. Pat. No. 6,182,381 entitled "Sole of baseball spiked shoe and method of measuring shearing stress distribution of baseball spiked shoe" discuss means for measuring stresses on shoes using accelerometers and other sensors to provide information that can be used in enhancing shoe design but do not show the innovative combination of the present invention. The use of accelerometers and other sensors in ambient conditions has been disclosed in U.S. Pat. No. 5,456,027 to Tecchio et al. entitled "Athletic Shoe With A Detachable Sole Having An Electronic Breakaway System" but does not disclose an active cleat system whose purpose is to actively enhance traction of the shoe according the present invention. These types of sensors and control circuitry may be employed in a new and different application according to the present invention by activating cleats or other surface traction devices based on readings provided by the sensors and other circuitry.

In accordance with a preferred embodiment of the invention, there is shown an active shoe cleat system with a shoe having a sole portion for supporting the wearer's foot, at least one chamber provided in the sole portion, a processor in the chamber operably connected to a plurality of cleats on the bottom of the shoe, at least one sensor in the shoe that measures at least one parameter pertaining to movement of the shoe, a projection within the cleat that is deployed in response to a control signal from the processor, the control signal is generated in response to data processed by the processor from information provided in part by the sensor and means for urging the projection outward from within the cleat.

In accordance with a preferred embodiment of the invention, there is also shown an active shoe cleat system with a shoe having a sole portion for supporting the wearer's foot, at least one chamber provided in the sole portion, a processor in the chamber operably connected to a generator of fluid pressure that engages at least one cleat on the bottom of the shoe, at least one sensor in the shoe that measures at least one parameter pertaining to the movement of the shoe, a projection within the cleat that is deployed in response to fluid pressure from the generator in response to a control signal from the processor where the control signal is generated in response to data processed by the processor from information provided in part by the sensor.

In accordance with a preferred embodiment of the invention, there is shown an athletic shoe for increasing traction as well as speed and efficiency of manuverability with a sole member having a plurality of ground-contacting cleats, the cleats operably connected to a central processing unit, the cleat being movable between an extended position and a retracted position in response to sensing means, means for holding the cleats in the extended position and means for releasing the members to the retracted position, control means for releasing the holding means and for allowing the release means to move the cleat to the release position when a force exceeds a preset level in response to sensing means, and sensing means for sensing the force applied to the lower sole member and for signaling the control means for moving the cleats to the extended position.

BRIEF SUMMARY OF THE INVENTION

The primary advantage of the invention is to provide improved tractions as well as speed and efficiency of maneuverability through an active cleat system.

Another advantage of the invention is to provide cleats that are activated depending on ambient user conditions.

Another advantage of the invention is to provide a cleat system that projects the cleats outward from the shoe based on a function whose inputs include but are not limited to acceleration, force, weight, temperature etc.

Another advantage of the invention is to provide an active system for widening the shoe bottom surface area in real time to enhance traction.

Another advantage of the invention is that it makes use of various microelectronics to achieve full implementation of the system.

Other objects and advantages of the present invention will become apparent from the following descriptions, taken in connection with the accompanying drawings, wherein, by way of illustration and example, an embodiment of the present invention is disclosed.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
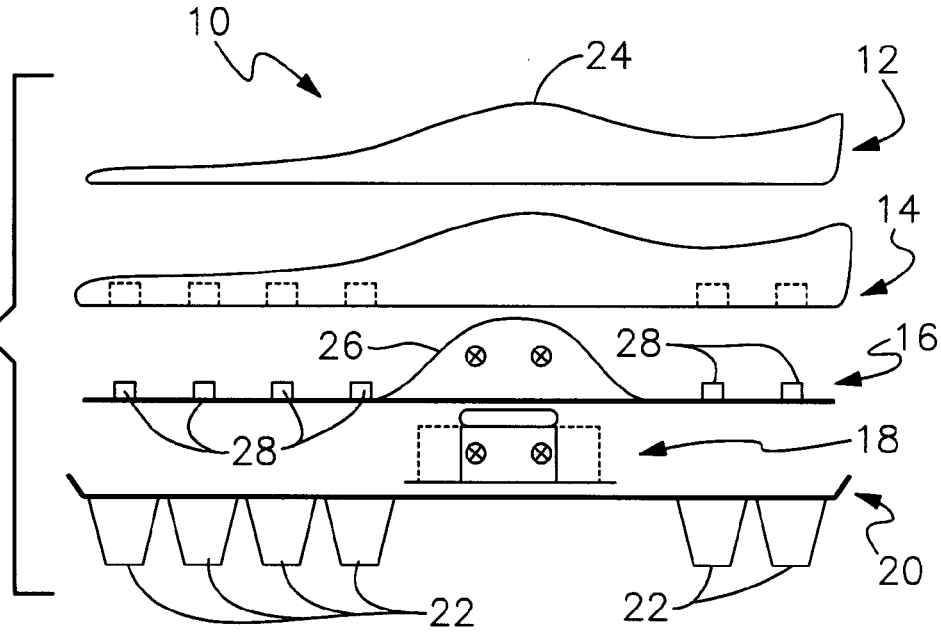
FIG. 1 shows an exploded cross sectional view of a preferred embodiment of a portion of a shoe according to a preferred embodiment of the invention.

Turning now to FIG. 1, there is shown a cross section of a cleated shoe sole 10 with layers 12, 14 16 and 20 that form the sole of the shoe. Arch 24 contains space under the arch to facilitate locating a central processing unit (CPU) 18 in the sole. With sensors 28 located along a bottom surface inside the shoe, CPU 18 is preferably located in the arch and various motors, transmission gears, and drive shafts or cables (not shown) are located at strategic locations about the active cleats 22 for controlled responsive activation of the cleats. The sensors may be of any of a variety including piezoelectric crystals, magnetics, temperature, force, weight and solid state accelerometers or other device that could sense an external effect and convert said effect into a usable signal for the CPU to give a control output in the shoe. The drive mechanism may be through a mechanical shaft or cable, hydraulic pressure based on a function of different factors including but not limited to speed, weight, terrain, acceleration, lateral acceleration and vertical acceleration as more fully described herein.

Figure 2:
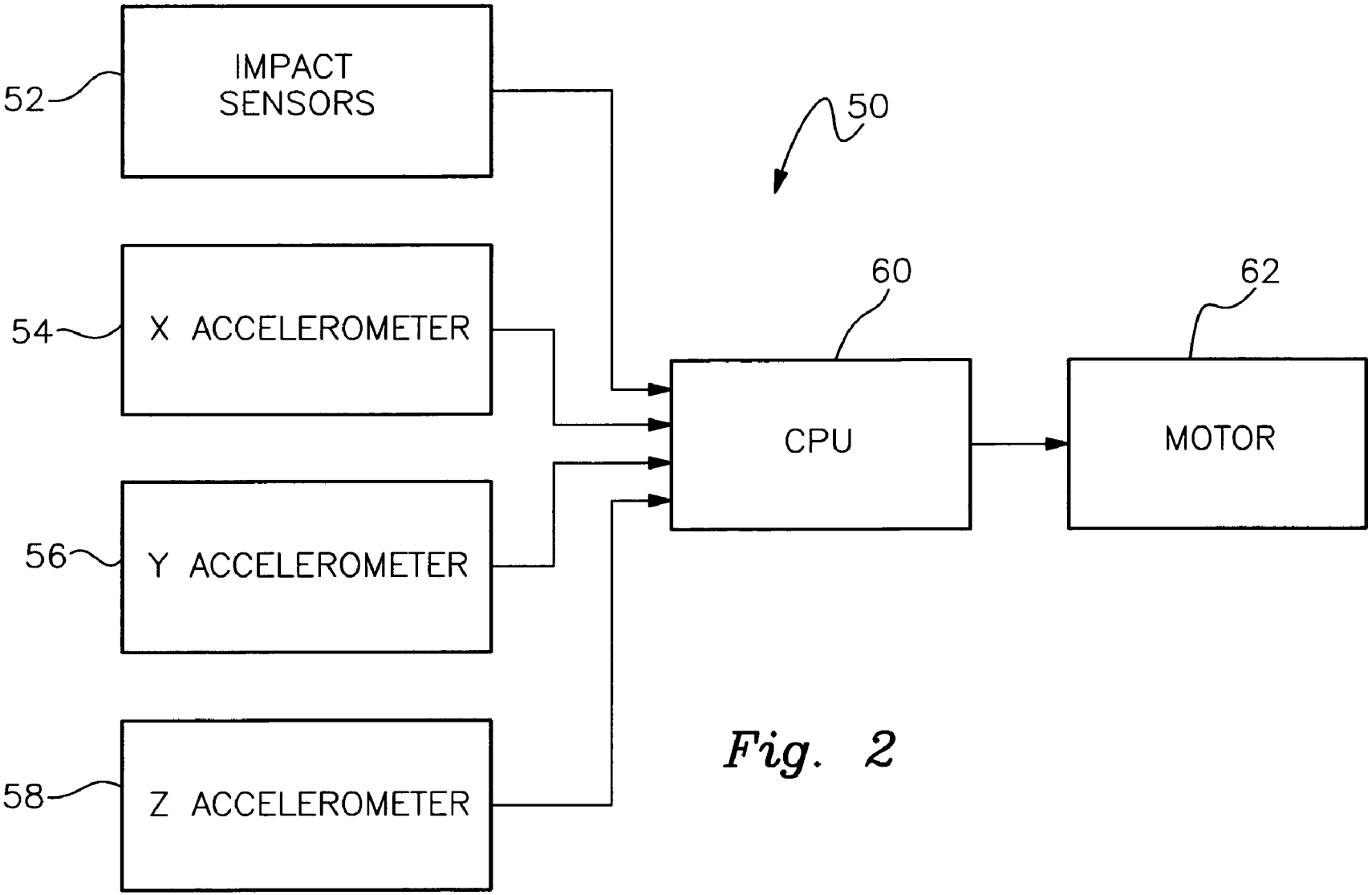
FIG. 2 shows a block diagram of a control unit according to a preferred embodiment of the invention.

FIG. 2 shows a block diagram 50 of the potential sensors and their relation to the CPU and motor. Sensors 52, 54, 56 and 58 are shown including impact sensor 52 which may be magnetic, weight, temperature, piezoelectric crystals or solid state accelerometers, and/or a three dimensional accelerometers as shown in the X, Y and Z orientations as accelerometers 54, 56 and 58 respectively. CPU 60 preferably has a sampling rate of several thousands of samples per second but may be of any a variety of rates to achieve the desired goals. Motor 62 which may one or a series of motors controlled by CPU 60 in response to sensor data electronically fed into CPU 60 by sensors 52, 54, 56 and 58. As data is collected from the sensors, CPU 60 processes the data and based on either predetermined criteria or other algorithm or program, activates the motor or motors to in turn activate cable tension, shaft work, hydraulics or other electronics to power the motors on the various cleat locations based on a function of the three one dimensional accelerometers or single three dimensional accelerometer, or based on other factors such as weight, velocity, temperature, force and other factors.

Figure 3:
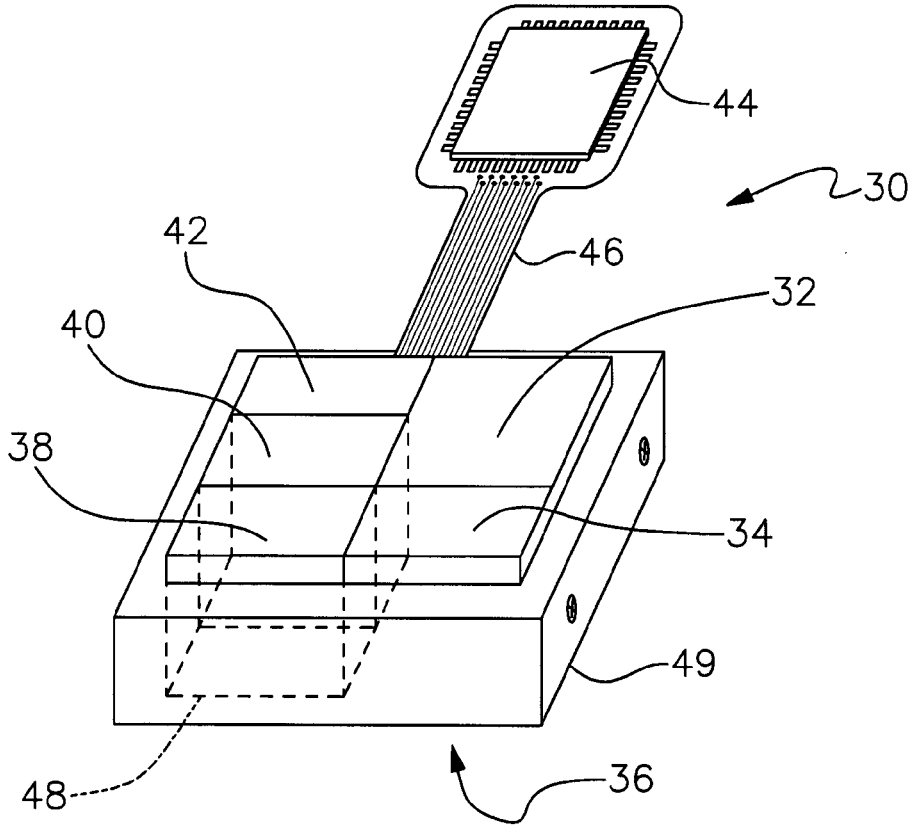
FIG. 3 shows a schematic perspective view of a control apparatus according to a preferred embodiment of the invention.

FIG. 3 shows a schematic diagram of control 30 where CPU 44 is connected via ribbon conductor 46 to input sensors, including Y axis accelerometer 42, Z axis accelerometer 40 and X axis accelerometer 34 maintained in housing 49. Also included in housing 49 operatively connected to CPU 44 is impact sensor 32 and power generator and supply 38. Housing 49 also includes a mechanical connection between the motor and transmission 48 to the active elements in the shoe cleat to activate the cleat according to a preferred embodiment of the invention. Control 30 is designed to be housed in the sole portion of a shoe or boot but in other embodiments may be in other portions of the shoe. Alternatively, the user may have access to a control to change the sensing parameters or control the cleats according to desired specifications while in use.

Figure 4:
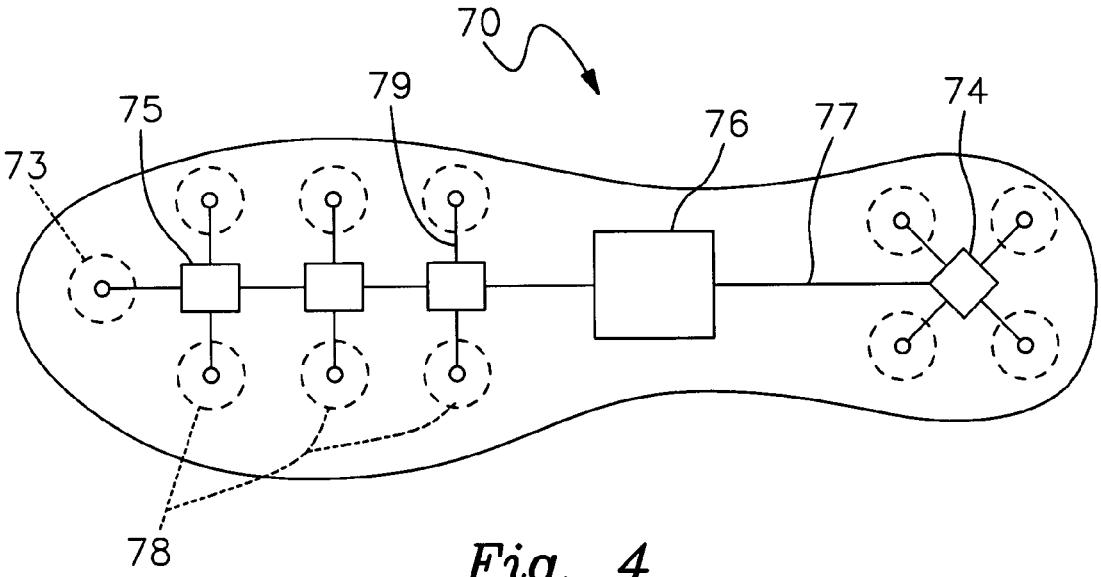
FIG. 4 shows a plan view of a shoe and cleat system according to a preferred embodiment of the invention.

FIG. 4 shows a bottom view of cleat system 70 with engine 76 in the arch portion of the shoe having a motor, transmission, and control with drive cables 77 or shaft 79 and gear boxes 74 and 75 (for example) for activation of each individual cleats 78. Each cleat may be individually controlled by cables 79 or be activated through gear box 75 as shown with cleat 73. The mechanical system for engaging the ground may include extendable flaps, spikes, stubs, frictional coefficient enhancers and surface area enhancers all controlled by the CPU and responsive to the various inputs from the sensors as more fully described herein.

Figure 5:
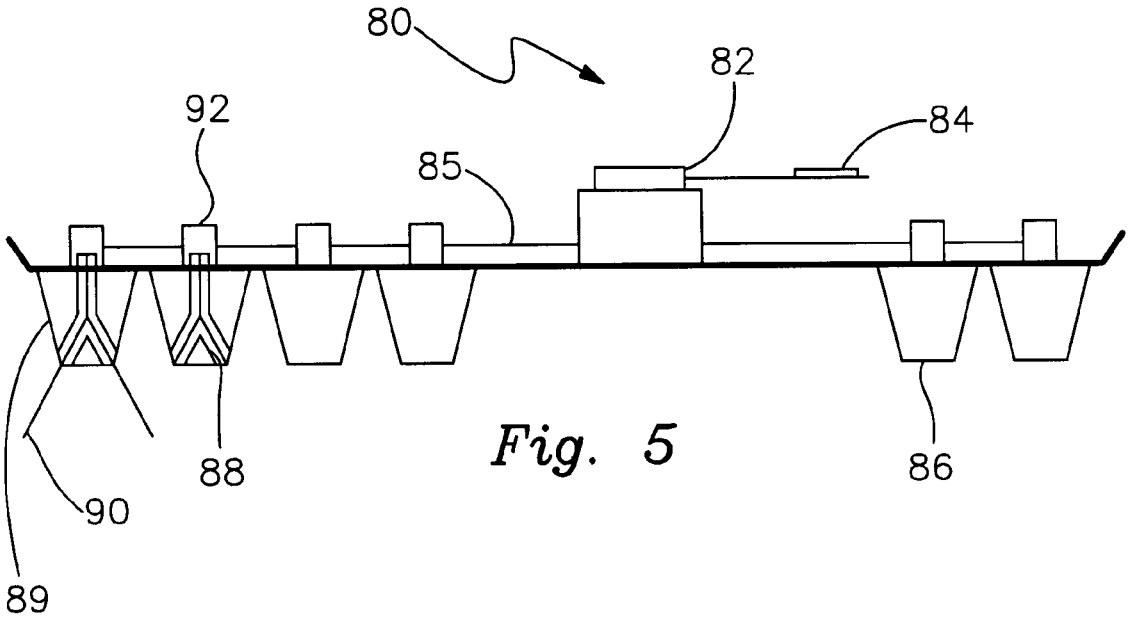
FIG. 5 shows a side cross sectional view of a cleat system according to a preferred embodiment of the invention.

FIG. 5 shows a side cross sectional view of cleat system 80 with sensor 84 connected to CPU 82 that in turn drives cleat activation. Each cleat has its own actuator 92 that drives the projections 90 outward from cleat 89 when activated. In this embodiment, each individual cleat is connected through wire 85 that received control signals from CPU 82 to activate each individual cleat according to cleat specific torque conditions and other factors all operating independently from the other cleats. Cleat 88 is shown in a non-deployed state whereas cleat 89 has been engaged and projections 90 are deployed to engage the ground and increase traction. As the system is operating, each individual cleat engages the ground as controlled by the CPU. The projections are deployed and retracted depending on the control signals from the CPU to best increase traction in a real time basis. Deployment may be of any of a variety of extensions since each projection may be individually controlled and may be fully or partially extended.

Figure 6:
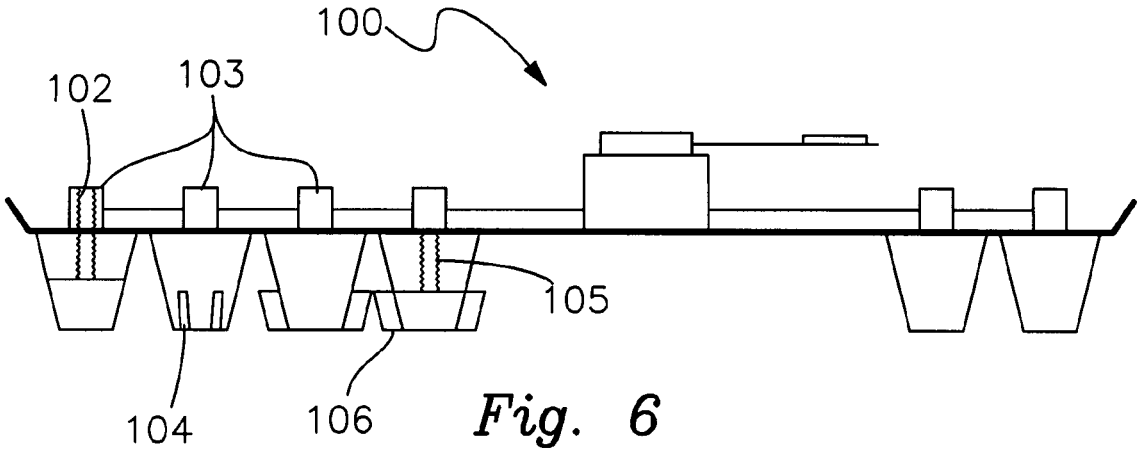
FIG. 6 shows a side cross sectional view of a cleat system according to a preferred embodiment of the invention.

FIG. 6 shoes an embodiment of retractable spikes 104 that are driven by elemental shaft 102 that is engaged in each of the cleats by telescoping outward from the cleat upon a signal from the control circuit. Upon activation, element shaft 102 is pushed downward by action of the gearbox 103 on spike 104 which is in turn pushed downward and projects beyond the outer periphery of the cleat. The deployed cleat is shown as deployed spike 106 with elemental shaft 105 pushed downward. Each cleat is separately controllable through the main CPU and drive transmission or electrical signals to gearboxes 103.

Figure 7:
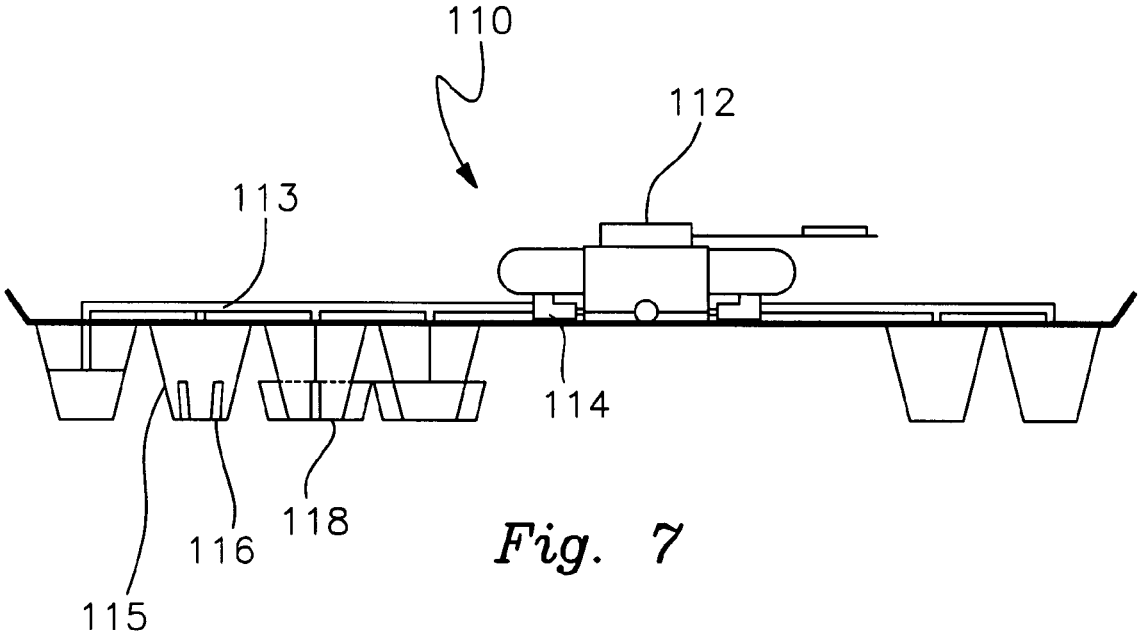
FIG. 7 shows a side cross sectional view of a cleat system according to a preferred embodiment of the invention.

FIG. 7 shows another embodiment using a hydraulic drive 112 that is connected via tubes 113 to activate individual cleats 115 by engaging projection 116 and pushing it outward in response to a control signal that deploys as shown in projection 118.

Figure 8A:
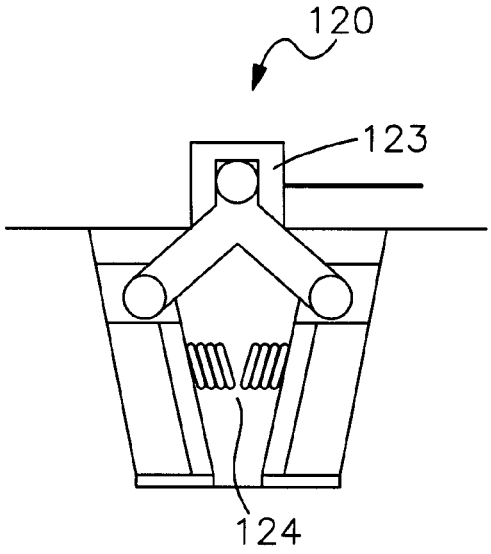
FIGS. 8A and 8B show side cross sectional views of a cleat system employing hydraulic action according to a preferred embodiment of the invention.
Figure 8B:
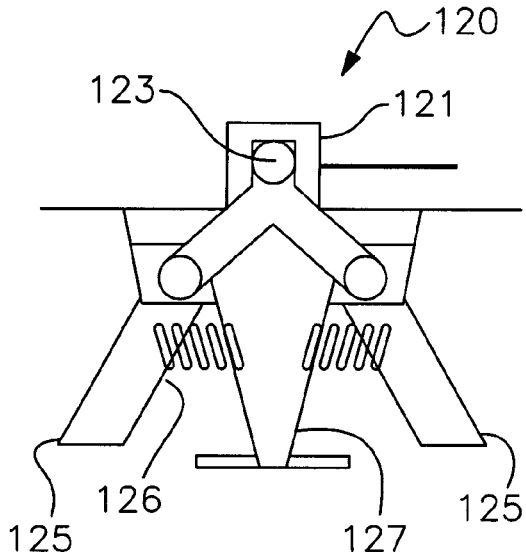

FIGS. 8A and 8B show another surface area enhancer 120 whereby the individual cleat is a three part mechanism driven by a gearbox 121 that upon actuation from a signal from the control circuit, expands the cleat by spreading legs 125 outward against biasing springs 126 and projecting center leg 127 downward. As the cleat is engaged, the three components of the cleat push outward creating greater surface area and hence a greater degree of traction. In an alternative embodiment, one could employ radio frequency wireless or intra red wireless or other electromagnetic frequency for control and actuation for cleat command in conjunction with feedback from the sensors and actuation system working in unison. This would allow for a smaller profile and permit systems to be placed in various positions throughout the shoe. The wireless system could also be adapted to transmit data regarding ambient conditions and permit a third party to adjust or control the reaction profile of the shoe system while in use.

Figure 9:
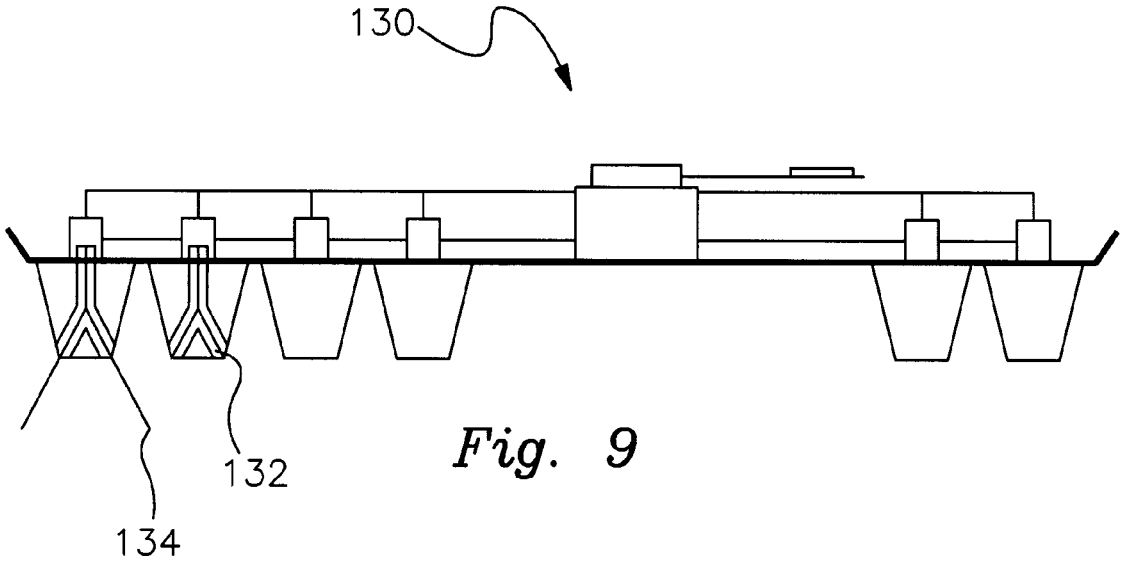
FIG. 9 shows a side cross sectional view of a cleat system according to a preferred embodiment of the invention.

FIG. 9 shows another embodiment using a hydraulic drive system 130 to deploy any of a number of traction enhancers 134 already discussed. By using standard hydraulics of a piston and worm gear and master cylinder arrangement, hydraulic fluid can be used to actively drive the various cleat enhancers in real time in response to the sensors and calculation of the CPU. FIG. 9 shows a retractable spike system with individual control and gearboxes that activate the active element for extending and retracting the element.

Figure 10A:
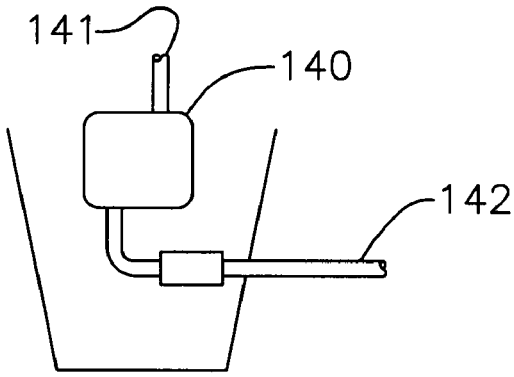
FIGS. 10A, 10B and 10C show side cross sectional views of a cleat system according to a preferred embodiment of the invention.
Figure 10B:
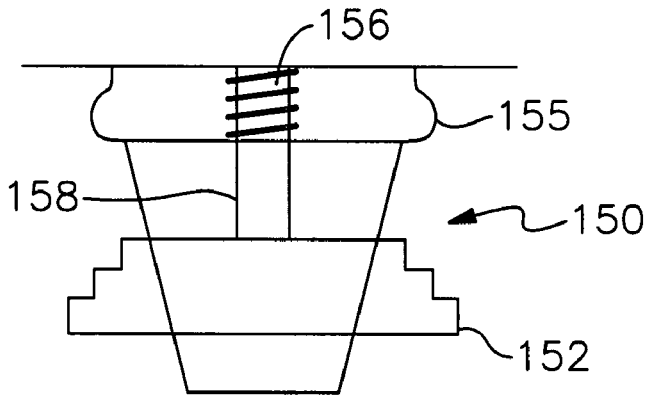
Figure 10C:
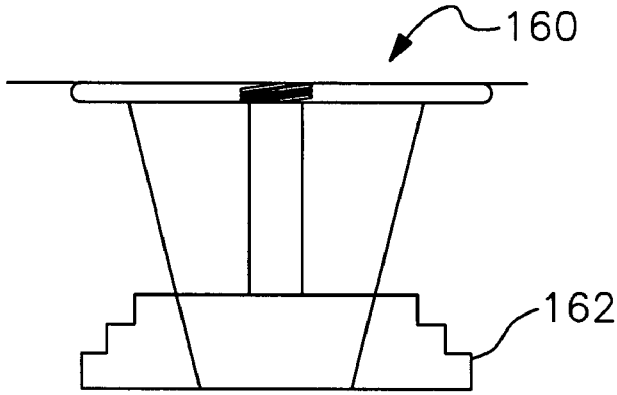

FIG. 10A shows a reservoir 140 operably connected through tube 141 to a motor (not shown) or other drive mechanism for activation through hydraulic tube 142. Reservoir 140 may also be gas or air filled and be operably connected to a pneumatic drive system using pressure to engage individual cleats as discussed herein. FIG. 10B shows an alternative cleat mechanism with a circumferential extension 152 placed about cleat 150 that is engaged through any of a number of mechanisms for control of the cleat activation such as hydraulics, pneumatics, mechanical pulley or shaft and spring operations, or electromechanical devices. Extension 152 is spring biased by spring 156 in the upward or non-deployed position. Upon activation as heretofore described, drive bellow 155 is compressed against spring 156 which in turn pushes drive shaft 158 downward which is connected to extension 152 thereby deploying the active cleat element. The extension 152 creates greater surface area for the individual cleat and in turn increases traction. Each cleat may be separately operated as described herein to increase traction as needed. Alternatively, the various cleat systems described herein may deploy a plurality of cleats at the same time to reduce processing and control demands. It is well known in the art of control how to manage a number of deployments based on sensor data and achieve the optimal combination of deployment for the particular circumstance.

While the invention has been described in connection with several preferred embodiments, it is not intended to limit the scope of the invention to the particular form set forth, but on the contrary, it is intended to cover such alternatives, modifications, and equivalents as may be included within the spirit and scope of the invention as defined by the following claims.

I claim:

1. A an active shoe cleat system comprising:

a shoe having a sole portion for supporting the wearer's foot;

at least one chamber provided in said sole portion, a processor in said chamber operably connected to a at least one cleat on the bottom of said shoe;

at least one sensor in said shoe that measures at least one parameter pertaining to movement of the shoe;

a projection within said cleat that is deployed in response to a control signal from said processor;

said control signal is generated in response to data processed by said processor from information provided in part by said sensor; and means for urging said projection outward from within said cleat.

2. An active shoe cleat system as claimed in claim 1 wherein said sensor measures acceleration on said shoe.

3. An active shoe cleat system as claimed in claim 1 wherein said sensor measures force on said shoe.

4. An active shoe cleat system as claimed in claim 1 further comprising a gear box that engages said cleat in response to said control signal.

5. An active shoe cleat system as claimed in claim 1 wherein said cleat has a multi-fin projection.

6. An active shoe cleat system as claimed in claim 4 further comprising a spring in said cleat that biases said projection in a retracted position.

7. An active shoe cleat system as claimed in claim 1 further comprising a control cable operably connected to said cleat and a motor for moving said cable.

8. A an active shoe cleat system comprising:

a shoe having a sole portion for supporting the wearer's foot;

at least one chamber provided in said sole portion, a processor in said chamber operably connected to a generator of fluid pressure that engages at least one cleat on the bottom of said shoe;

at least one sensor in said shoe that measures at least one parameter pertaining to the movement of the shoe;

a projection within said cleat that is deployed in response to fluid pressure from said generator in response to a control signal from said processor;

wherein said control signal is generated in response to data processed by said processor from information provided in part by said sensor.

9. An active shoe cleat system as claimed in claim 8 further comprising a reservoir operably connected to said cleat for deployment of said cleat.

10. An active shoe cleat system as claimed in claim 8 wherein said reservoir contains a gas.

11. An active shoe cleat system as claimed in claim 8 wherein said reservoir contains a liquid.

12. An athletic shoe for increasing traction comprising:

a sole member having a plurality of ground-contacting cleats;

said cleats operably connected to a central processing unit;

at least one of said cleats being movable between an extended position and a retracted position in response to sensing means;

means for holding said cleats in said extended position and means for releasing said members to said retracted position;

control means for releasing said holding means and for allowing said release means to move said cleat to said release position when a force exceeds a preset level in response to sensing means; and sensing means for sensing the force applied to said lower sole member and for signaling said control means for moving said cleats to said extended position.

13. An active shoe cleat system as claimed in claim 12 wherein said sensing means is an accelerometer.

14. An active shoe cleat system as claimed in claim 12 further comprising a gear box operably connected to said cleat.

15. An active shoe cleat system as claimed in claim 12 further comprising a spring biased projection in said cleat.

* * * * *